US009951518B2

(12) United States Patent
McDuff

(10) Patent No.: US 9,951,518 B2
(45) Date of Patent: Apr. 24, 2018

(54) TILE SYSTEM FOR SUSPENDED CEILING AND WALL, AND METHOD

(71) Applicant: GESTION MCD INC., Saint-Bruno-de-Montarville (CA)

(72) Inventor: Rodrigue McDuff, Saint-Bruno-de-Montarville (CA)

(73) Assignee: GESTION MCD INC. (CA)

( * ) Notice: Subject to any disclaimer, the term of this patent is extended or adjusted under 35 U.S.C. 154(b) by 0 days.

(21) Appl. No.: 15/086,850

(22) Filed: Mar. 31, 2016

(65) Prior Publication Data

US 2016/0289963 A1 Oct. 6, 2016

Related U.S. Application Data

(60) Provisional application No. 62/140,649, filed on Mar. 31, 2015.

(51) Int. Cl.

| | |
|---|---|
| ***E04B 9/06*** | (2006.01) |
| ***E04B 9/28*** | (2006.01) |
| ***E04B 9/12*** | (2006.01) |
| ***E04F 13/09*** | (2006.01) |
| ***E04F 13/08*** | (2006.01) |

(Continued)

(52) U.S. Cl.

CPC ..... *E04B 9/067* (2013.01); *E04B 9/12* (2013.01); *E04B 9/28* (2013.01); *E04F 13/0814* (2013.01); *E04F 13/0821* (2013.01); *E04F 13/0894* (2013.01); *E04F 13/09* (2013.01); *E04F 13/12* (2013.01); *E04F 13/18* (2013.01)

(58) Field of Classification Search

CPC .... E04B 9/12; E04B 9/28; E04B 9/067; E04F 13/0894; E04F 13/09

USPC ..... 52/506.07, 591.1, 592.1

See application file for complete search history.

(56) References Cited

U.S. PATENT DOCUMENTS 357,144 A * 2/1887 Buttler ..... E04F 15/04 52/384

841,490 A * 1/1907 Du Montier ..... 52/591.2

(Continued)

FOREIGN PATENT DOCUMENTS

WO WO 2005019557 A1 * 3/2005 ..... E04B 9/001

*Primary Examiner* — Adriana Figueroa

(74) *Attorney, Agent, or Firm* — Norton Rose Fulbright Canada LLP

(57) ABSTRACT

A tile system for use on a grid of a suspended ceiling comprises a plurality of tiles, each said tile having a main body having an exposed side and a concealed side, the exposed side defining a main surface, the concealed side defining a rear plane, and four side surfaces between the exposed side and the concealed side of the main body, wherein two of the four side surfaces have at least one tongue in the rear plane, and two other of the four side surfaces have at least one groove open to the rear plane. Fasteners, such as clips, are configured for attaching the tongues of one of the tiles to upside-down T channels of the grid, such that the rear plane of the tile is against a downwardly facing surface of the T channels of the grid. The tiles are arranged such that, for a pair of the tiles side by side and sharing a same channel, one of the tiles has its at least one tongue connected to the channel by said fasteners, and the other of the tiles has its at least one groove receiving the at least one tongue of the adjacent tile. A method of installation is also provided.

12 Claims, 11 Drawing Sheets

(51) Int. Cl.
*E04F 13/12* (2006.01)
*E04F 13/18* (2006.01)

(56) References Cited

U.S. PATENT DOCUMENTS 2,335,303 A * 11/1943 Olsen ..... E04B 9/22 52/489.2
2,831,222 A * 4/1958 Anderson ..... E04F 13/0826 52/489.1
2,851,134 A * 9/1958 Robinson, Jr. ..... E04F 13/12 52/385
3,241,282 A * 3/1966 Kemp ..... E04B 9/001 52/506.1
3,290,848 A * 12/1966 Moss ..... E04L 39/0478 52/506.1
3,359,695 A * 12/1967 Gazerro ..... E04B 9/247 52/127.8
4,444,524 A * 4/1984 Cook ..... E04B 9/24 403/387
4,665,669 A * 5/1987 Neuser ..... E04B 9/22 52/506.08
4,696,141 A * 9/1987 Nassof ..... E04B 9/28 52/145
4,760,677 A * 8/1988 Nassof ..... E04B 9/28 52/145
5,136,823 A * 8/1992 Pellegrino ..... E04D 1/08 52/539
5,893,250 A * 4/1999 Benvenuto ..... E04B 9/0478 52/506.06
6,588,167 B2 * 7/2003 Chang ..... B44C 3/123 428/44
7,607,265 B2 * 10/2009 Curry ..... B32B 3/12 52/177
8,316,606 B2 * 11/2012 Siewert ..... E04F 13/10 52/483.1
8,726,603 B2 * 5/2014 Huang ..... E04F 15/02 52/591.1
8,806,837 B2 * 8/2014 Stone ..... E04B 9/04 52/489.2
2007/0214741 A1 * 9/2007 Llorens Miravet ..... E04F 15/02 52/592.1
2011/0252736 A1 * 10/2011 Bailey ..... E04B 9/245 52/506.07
2014/0215946 A1 8/2014 Roy et al.

* cited by examiner

TILE SYSTEM FOR SUSPENDED CEILING AND WALL, AND METHOD

CROSS-REFERENCE TO RELATED APPLICATION

The present application claims priority of U.S. Provisional Application No. 62/140,649, filed on Mar. 31, 2015, and incorporated herein by reference.

TECHNICAL FIELD

The present application relates to suspended ceilings and, more particularly, to a tile system for suspended ceilings and for walls.

BACKGROUND OF THE ART

Suspended ceilings are known in a plurality of different names, such as dropped ceilings, false ceilings and grid ceilings, among others. A typical dropped ceiling consists of a grid of metal or plastic channels used to support tiles or panels. The channels have an upside-down T-section and are suspended from an overhead structure by way of wires and fasteners. The metal channels form a grid in which acoustic panels, also known as ceiling tiles, are dropped into and supported by the grid.

Over time, the material of the grid may age and discolor, among other problems. This may even result in the replacement of grids, which is a time-consuming and costly operation. Moreover, the exposed grid is not unanimously esthetically pleasing. There have therefore been different designs to conceal the grid. However, such designs are known to be somewhat complex in enabling the removal of panels without damaging either the installation or the panels.

SUMMARY

It is therefore an aim of the present disclosure to provide a tile system that addresses issues related to the existing suspending ceilings.

It is a further aim of the present disclosure to use the tile system for suspending ceilings as wall surfacing.

It is a still further aim of the present disclosure to provide a novel method for installing a tile system to a suspended ceiling structure.

Therefore, in accordance with the present disclosure, there is provided a tile comprising: a main body having an exposed side and a concealed side, the exposed side defining a main surface, the concealed side defining a rear plane, and four side surfaces between the exposed side and the concealed side of the main body, wherein two of the four side surfaces have a first tongue-and-groove arrangement in the rear plane, and two other of the four side surfaces have a second tongue-and-groove arrangement in the rear plane, the first tongue-and-groove arrangement being complementary to the second tongue-and-groove arrangement, for complementary engagement of two of the tile side by side.

Further in accordance with the present disclosure, there is provided a tile system for use on a grid of a suspended ceiling, comprising: a plurality of tiles, each said tile having a main body having an exposed side and a concealed side, the exposed side defining a main surface, the concealed side defining a rear plane, and four side surfaces between the exposed side and the concealed side of the main body, wherein two of the four side surfaces have at least one tongue in the rear plane, and two other of the four side surfaces have at least one groove open to the rear plane; and fasteners configured for attaching the tongues of one of the tiles to upside-down T channels of the grid, such that the rear plane of the tile is against a downwardly facing surface of the T channels of the grid; wherein the tiles are arranged such that, for a pair of the tiles side by side and sharing a same channel, one of the tiles has its at least one tongue connected to the channel by said fasteners, and the other of the tiles has its at least one groove receiving the at least one tongue of the adjacent tile.

Still further in accordance with the present disclosure, there is provided a method for installing tiles to a grid of a suspended ceiling, comprising: positioning a first tile against the grid such that the tile is aligned with a cell of the grid and a rear plane of the first tile is against a downwardly facing surface of the channels of the grid; fastening tongues of at least two side surfaces of the first tile to the channels; and inserting at least one tongue of a second tile in at least one groove of the first tile such that the at least one tongue of the second tile is sandwiched between the at least one groove and the downwardly facing surface of the channels of the grid.

DETAILED DESCRIPTION

Figure 1:
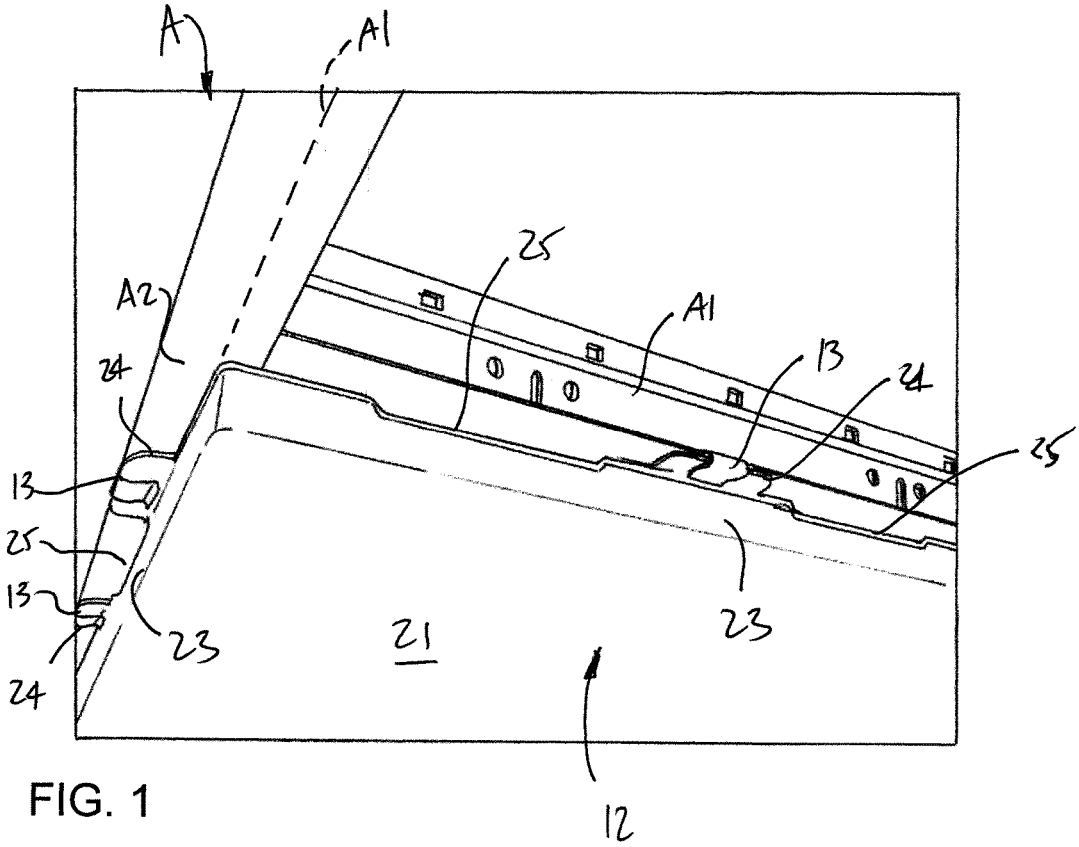
FIG. 1 is a perspective view of a tile system of the present disclosure, as secured to a grid or suspended ceiling structure.

Referring to the drawings and, more particularly, to FIG. 1, a tile system in accordance with the present disclosure, is shown at 10, relative to a grid A formed of a plurality of upside-down T channels. The T channels may also be known as supports, extrusions, brackets, strips, etc, and are elongated members of metal, plastic, etc that are conventionally used to form the grid A. The tile system 10 may be used as a retrofit system used with an existing grid A or a new grid A, in both cases the grid A being constituted of conventional T channels, made of two elongated strip portions interconnected at a right angle to form the T shape. The grid A may also be referred to the structure of a suspended ceiling.

When used as part of a suspended ceiling, the tile system 10 globally has a plurality of tiles 12 as well as plurality of clips 13. End mouldings 14 may be used, the end moulding 14 being shown in FIGS. 7, 8 and 9. The tiles 12, also known as panels, form the suspended ceiling. The clips 13 are used to connect some of the tiles 12 to the grid A in such a way that the grid A is substantially concealed and may therefore not visible from the floor. The end moulding 14 is used at the junction between the tiles 12 and a vertical wall.

Tiles 12

Referring concurrently to FIGS. 1, 9, 10 and 11, a tile 12 is shown in greater detail. The tile 12 may be made of any appropriate material and have various properties. For example, the tile 12 may be an acoustic tile having an inner body of acoustic felt 12A or like non-structural filler material with a decorative shell 12B supporting and accommodating the acoustic felt 12A, the decorative shell 12B facing downwardly when the tile 12 is installed, to form the visible part of the tile 12. Such a tile 12 may result from a lamination process. As alternatives, the tile 12 may be molded in a single material, or be laminated from different materials, etc. For example, the tile 12 may consists of a single monolithic polymeric material, or may be an assembly of difference materials. The decorative shell 12B may even be made in a metallic material, etc. In the illustrated embodiment, the decorative shell 12B is a single piece shell, defining a hollow cavity on its concealed side in which the non-structural filler material may be received.

Figure 11:
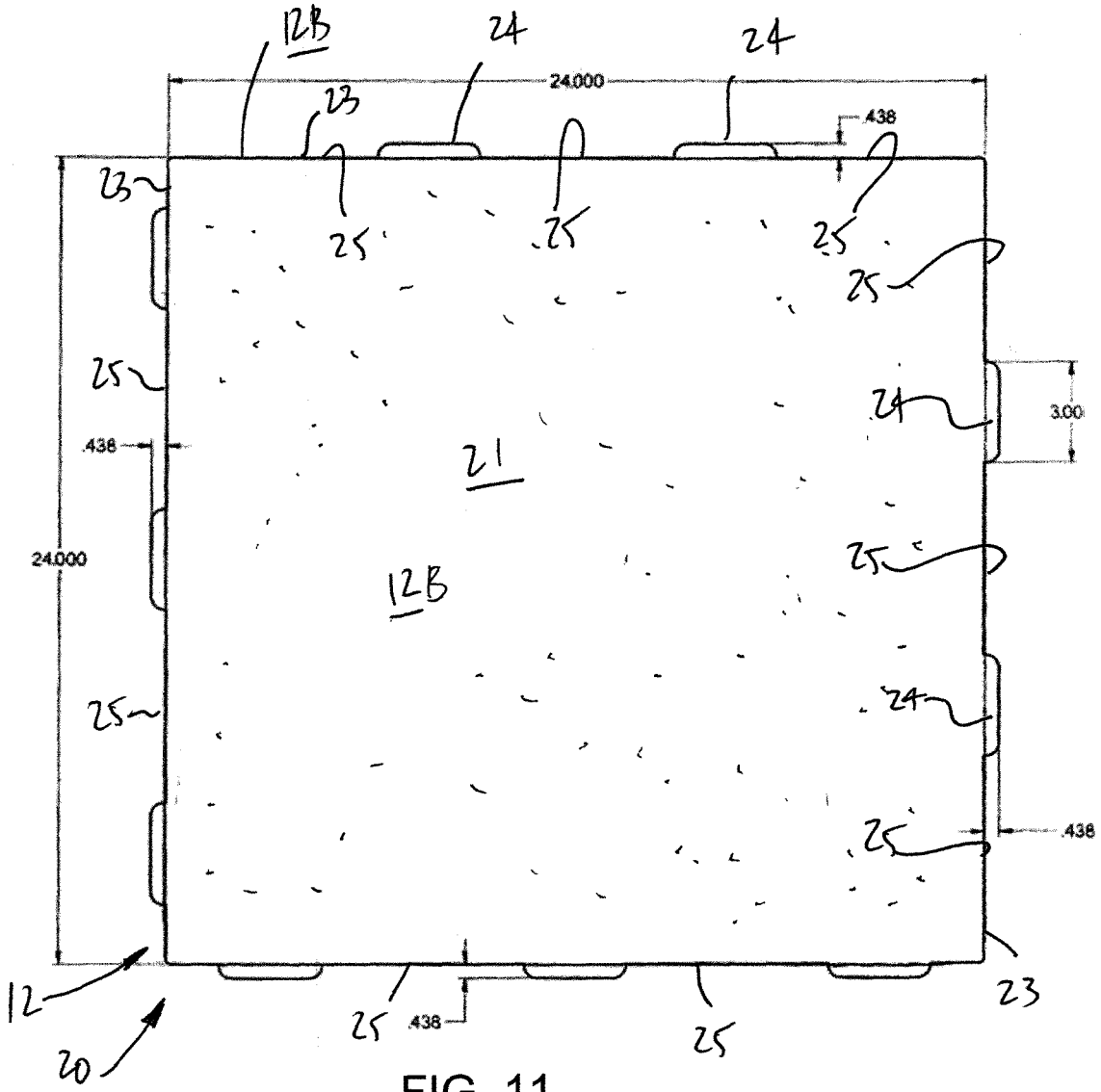
FIG. 11 is a bottom view of the tile of FIG. 10.

The tile 12 has a main body 20 of rectangular shape (including a square shape as in the illustrated embodiment), based on the grid A, which incorporates the decorative shell 12B. Other geometrical shapes are considered, as a function of the cell shape of the cells of the grid A. The main body 20 has an exposed surface 21 that faces downwardly when the tile system 10 is installed. Although shown as being smooth, the exposed surface 21 may have geometrical shapes and 3D patterns defined therein, for decorative purposes among other reasons. A concealed side 22 is on the other side of the main body 20, and is conventionally arranged to face upward toward the overhead structure, such that its rear most plane, at its periphery, contacts the downwardly facing surfaces of the grid A, as described hereinafter. Side surfaces 23 define the perimeter of the main body 20 between the two main surfaces 21 and side or surface 22. The side surfaces 23 generally span the thickness of the main body 20. The side surfaces are concurrently referred to as 23, although they are illustrated in FIG. 11 as 23A and 23B, for reasons explained below.

The side surfaces 23 are provided with tongue-and-groove arrangements in the rear plane, for complementary engagement of tiles 12 when positioned side by side, with complementary tongue-and-groove arrangements facing each other. Tongues 24 project laterally from the side surfaces 23, whereas grooves 25 are defined into the side surfaces 23. In an embodiment, the tongues 24 are projections from the decorative shell 12B. This is a possibility among others, with other embodiments featuring addition of strips to form the tongues 24, or tongues 24 being comolded with the main body 20. In an embodiment, the tongues 24 are generally coplanar with the concealed surface 22 as may be seen in FIG. 9, while the grooves 25 open to the concealed surface 22. It is also considered that a peripheral edge of the single piece shell of the main body 20, excluding grooves 25 of the tongue-and-groove arrangements, lies in the rear plane. When the tongues 24 are integral with the decorative shell 12B, the decorative shell 12B has a sufficient structural integrity and rigidity for the tongues 24 to support the weight of the whole tile 12 in suspension. In other words, the tile 12 will be hung by its tongues 24, whereby it is necessary that the tongues 24 be capable of sustaining the weight of the tile 12. It is also considered to have a single tongue 24. Such a single tongue 24 may be elongated to cover a substantial portion of the length of the side surface 23.

Figure 10:
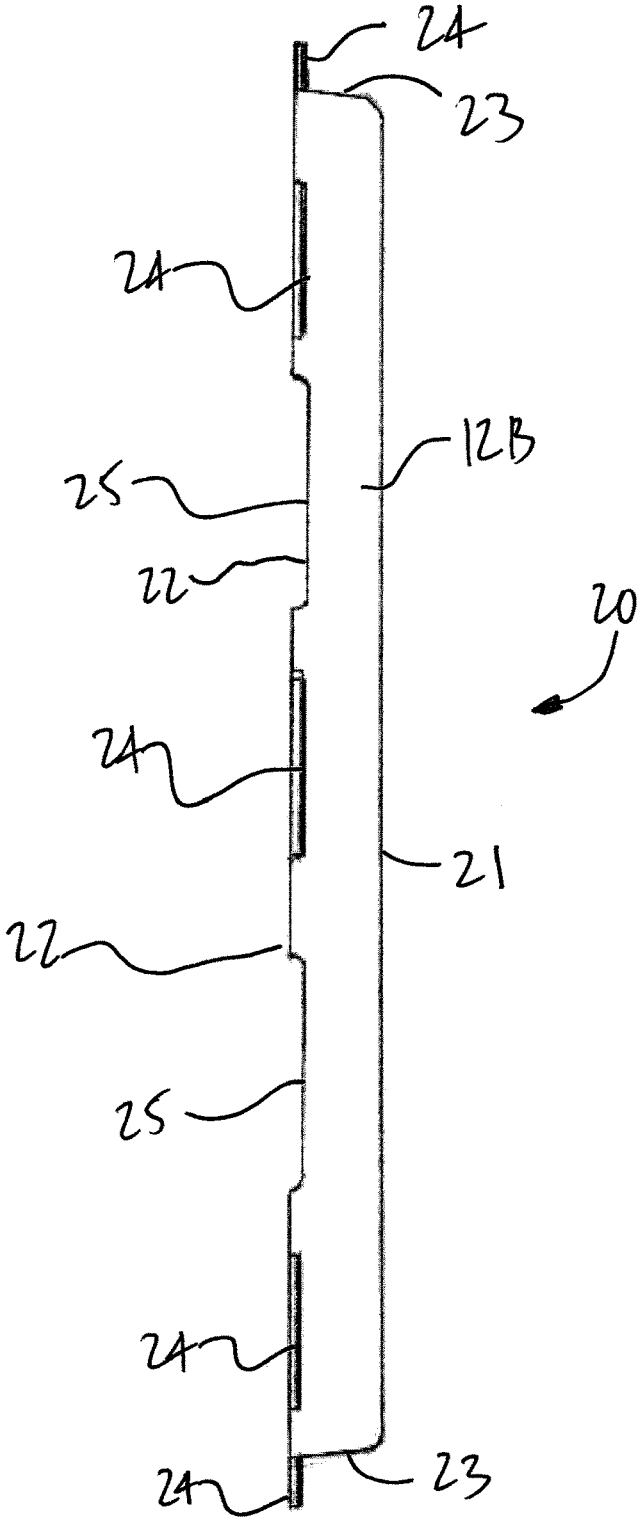
FIG. 10 is a side view of a tile of the tile system of FIG. 1.

The grooves 25 may be formed, laminated, machined, molded into the main body 20, or may result from the simple deformation of the material of the main body 20 when tongues 24 are fitted there. The grooves 25 on a first side surface 23 of a first tile 12 are used to receive the tongues 24 of the side surface 23 of an adjacent second tile 12. Therefore, considering that the tongues 24 are thin, the groove 25 need not be deep. In a tile 12, as best seen in FIGS. 10 and 11, adjacent tongues 24 are spaced apart by one of the grooves 25, and a sequence of alternating tongues 24 and grooves 25 is circumferentially distributed about the main body 20. As observed from FIG. 11, opposite side surfaces 23 of a same tile 12 are not mirror images of one another, as adjacent tiles 12 must have complementary tongue and groove patterns to be interconnected. As exemplified by FIG. 11, the tile 12 has three tongues 24/two grooves 25 on side surfaces 23A, and two tongues 24/three grooves 25 on the opposite side surface 23B. This is one possible pattern among others. In such a way, all tiles 12 may be the same, and have a unique tongue and groove pattern. It is however also contemplated to have two sets of tiles 12, with each side of a first type of tile 12 being complementary to the sides of a second type of tile 12. The embodiment of FIG. 11 shows two side surfaces of type 23A, for two side surfaces of type 23B, with the side surfaces 23A being configured for complementary engagement with the side surfaces 23B, the opposite sides of the tile 12 being a 23A and 23B pair. However, a single tile 12 may have four different side surfaces, provided complementary engagement is possible with adjacent tiles 12. It is also considered to have a single elongated tongue 24 and no groove 25 on a side surface 23, and a complementary single elongated groove 25 and no groove 24 on another side surface 23.

Clip 13

Figure 2:
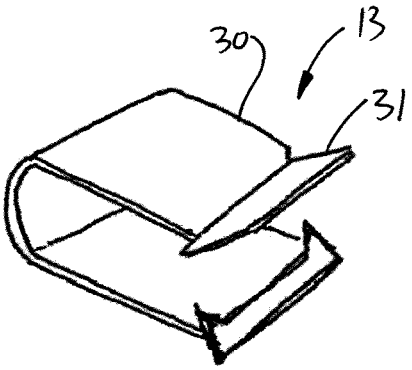
FIG. 2 is a perspective view of a clip of the tile system of the present disclosure.
Figure 8:
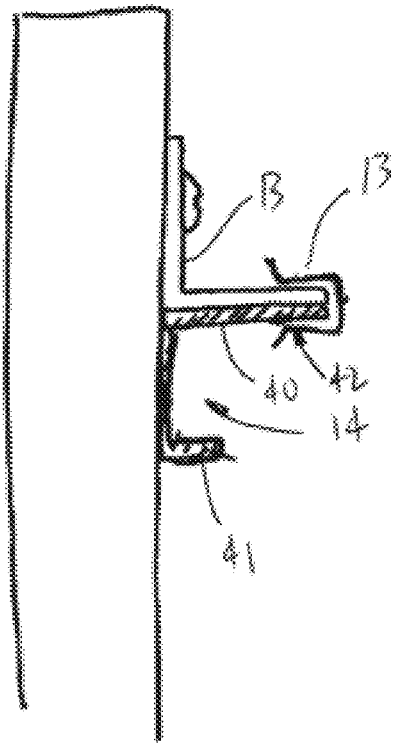
FIG. 8 is an elevation view of the assembly of FIG. 7, as connected by the clips of FIG. 2.
Figure 9:
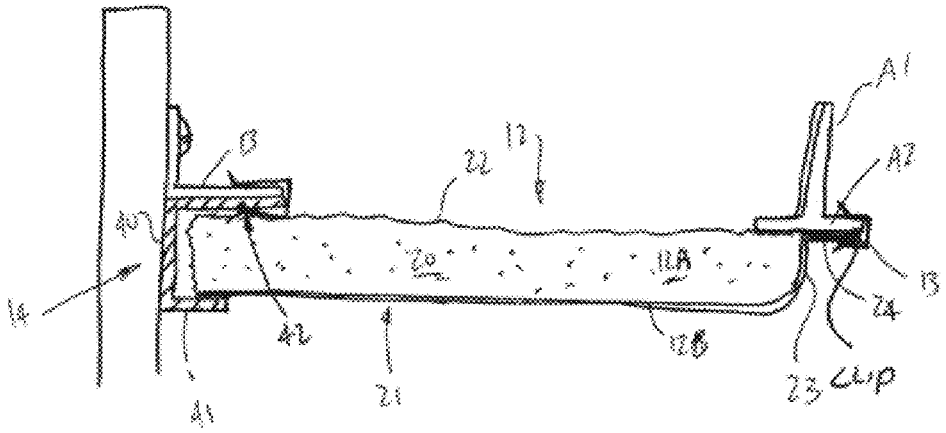
FIG. 9 is an assembly view of a tile of the tile system in the assembly of FIGS. 7 and 8.

Referring to FIGS. 2, 8 and 9, the clip 13 is shown in greater detail. In an embodiment, the clip 13 is made of a monolithic piece of material. For example, the clip 13 may consist of a bent metal piece shaped to apply a biasing force as described hereinafter, and to remain in a plastic deformation range even when used to connect tiles 12 to a supporting structure, as described below. The clip 13 is shown having a U-shaped body 30, which U-shaped body is oriented sideways when the clip 13 is used. The clip 13 may have one or both of its ends raised from the contact edge, as shown as 31, to facilitate its manipulation. The clip 13 of FIG. 2 is shown in its equilibrium state, and if the ends are distanced away from one another or brought together, the clip 13 will be in a biased state and will elastically return to its equilibrium state. As observed from FIGS. 1 and 9, the clip 13 is used to attach the tongue 24 to a strip portion of the T-channel of the grid A, by biasingly sandwiching the tongue 24 to the strip portion via elastic deformation. As such, the clip 13 must be sized to be away from its equilibrium state when connecting a tile 12 to a T channel, and therefore applies biasing pressure when attached in the manner shown in FIG. 9, by having a tendency to return to its equilibrium state.

Other attachment means may be used, such as standard fasteners (e.g., screws, bolts), an adhesive, Velcro®, etc. However, the clip 13 is a convenient and cost-effective solution.

Installation of Tile System 10

Now that the tiles 12 and clips 13 of the tile system 10 have been described, its installation to a suspended ceiling structure will be set forth. The method is described with the grid A already present. The grid A may be a legacy structure from a suspended ceiling, from which the previous old-generation tiles dropped onto the grid A. The grid A may also be a newly installed structure.

Figure 3:
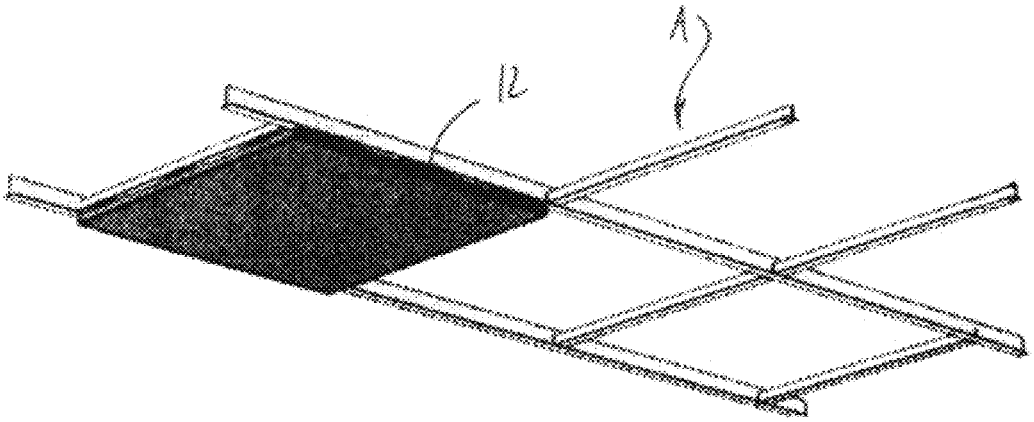
FIGS. 3 to 6 are sequential views showing the installation of tiles of the tile system of the present disclosure to a grid.

As shown in FIG. 3, the tile 12 is sized based on the size of the cells of grid A. To start installation, one of the tiles 12 is positioned in registry with a cell of the grid A. In doing so, as seen in FIGS. 1 and 9, a periphery of the concealed surface 22 of the tile 12 will abut an undersurface of the grid A, with the side surface 23 being aligned with the central strip portion A1 of the upside-down T channel. As the tongues 24 extend beyond the side surface 23, the tongues 24 will extend beyond the central strip portion A1 of the T channel, and thus be coplanar with branch or horizontal strip portion A2 of the T channel. Therefore, clips 13 may be used to sandwich the plurality of tongues 24 to the branch A2 of the channel. This may be done for all tongues 24 on all four side surfaces 23 of the tile 12, whereby the tile 12 is secured to the grid A and covers one of the cells. As described above, the clip 13 is sized to be out of its equilibrium state (into elastic deformation) when clipped to the tile 12 and strip portion A2, to exert a biasing action thereon. Although the clips 13 are easily installed, other fasteners may be used as well. For example, the tongues 24 may be stapled to the strip portion A2.

Figure 4:
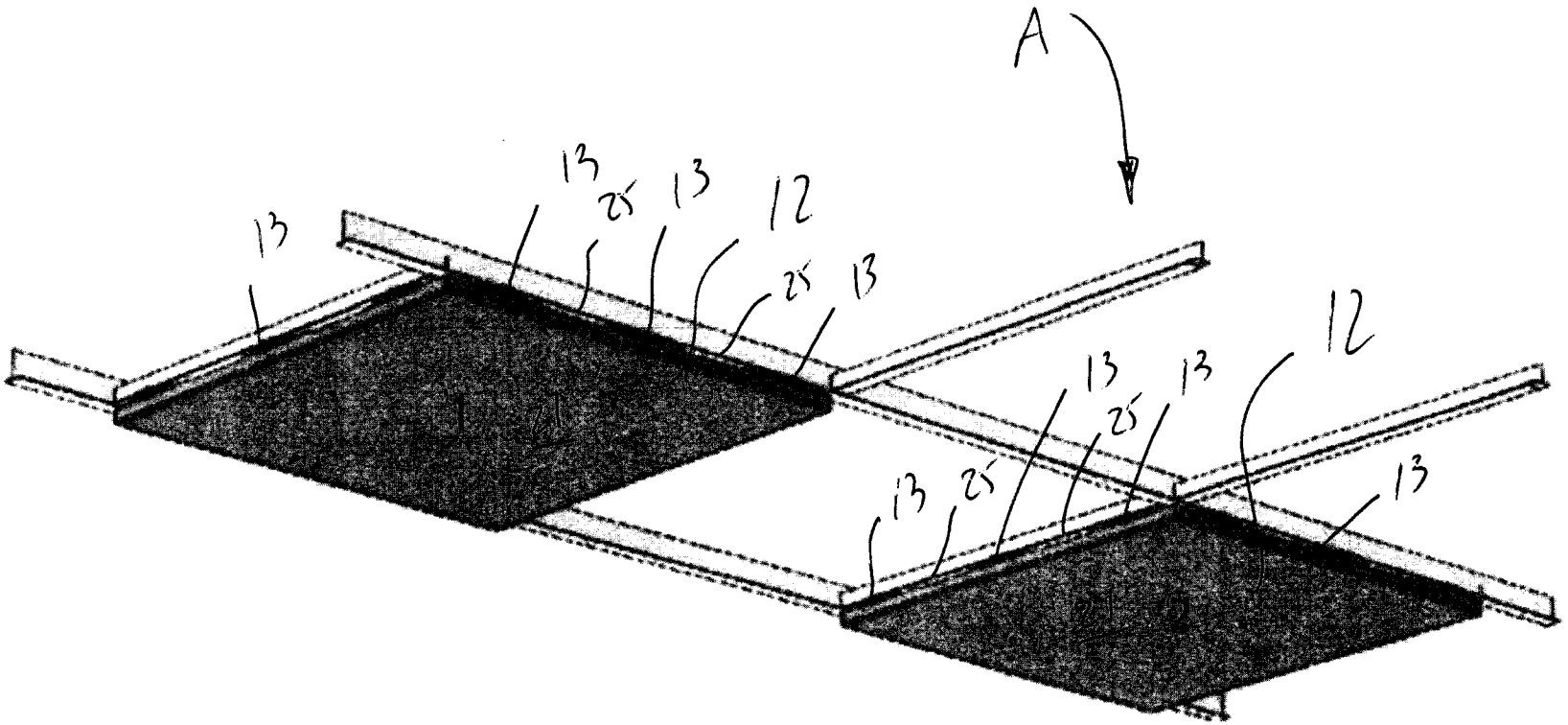

Referring to FIG. 4, this method of installation of a tile 12 with clips 13 or other fasteners is repeated with another tile 12, albeit not directly adjacent to the firstly installed tile 12, such that there remains an empty cell between the tiles 12.

Figure 5:
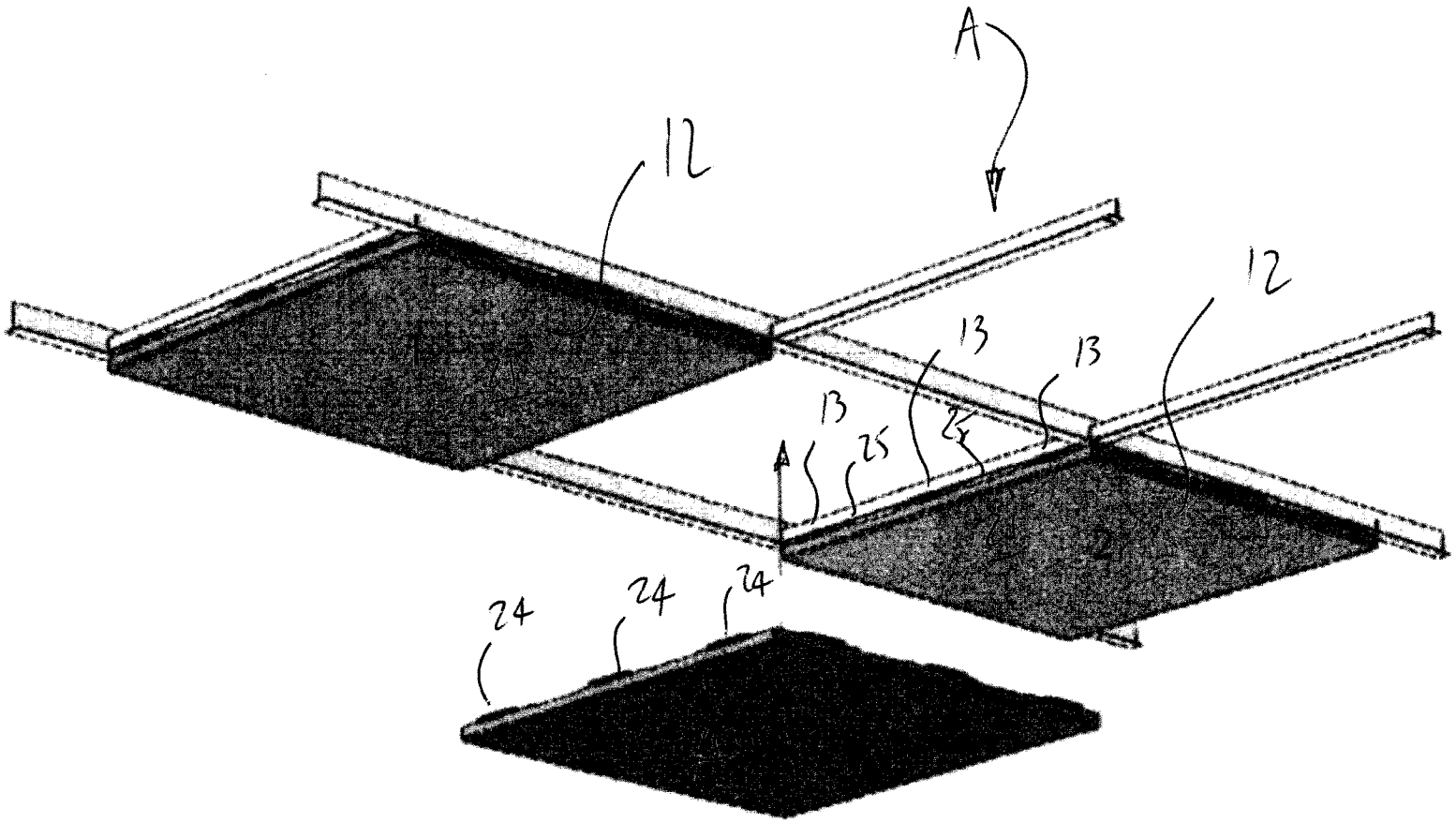

As a result, as shown in FIG. 5, there remains an empty cell between adjacent secured tiles 12. Accordingly, a third one of the tiles 12 may be positioned between the installed tiles 12. However, clips 13 are not to be used as the tongues 24 of this third tile 12 will be inserted into the grooves 25 of the installed tiles 12, the installed tiles 12 supporting the third tile 12.

Figure 6:
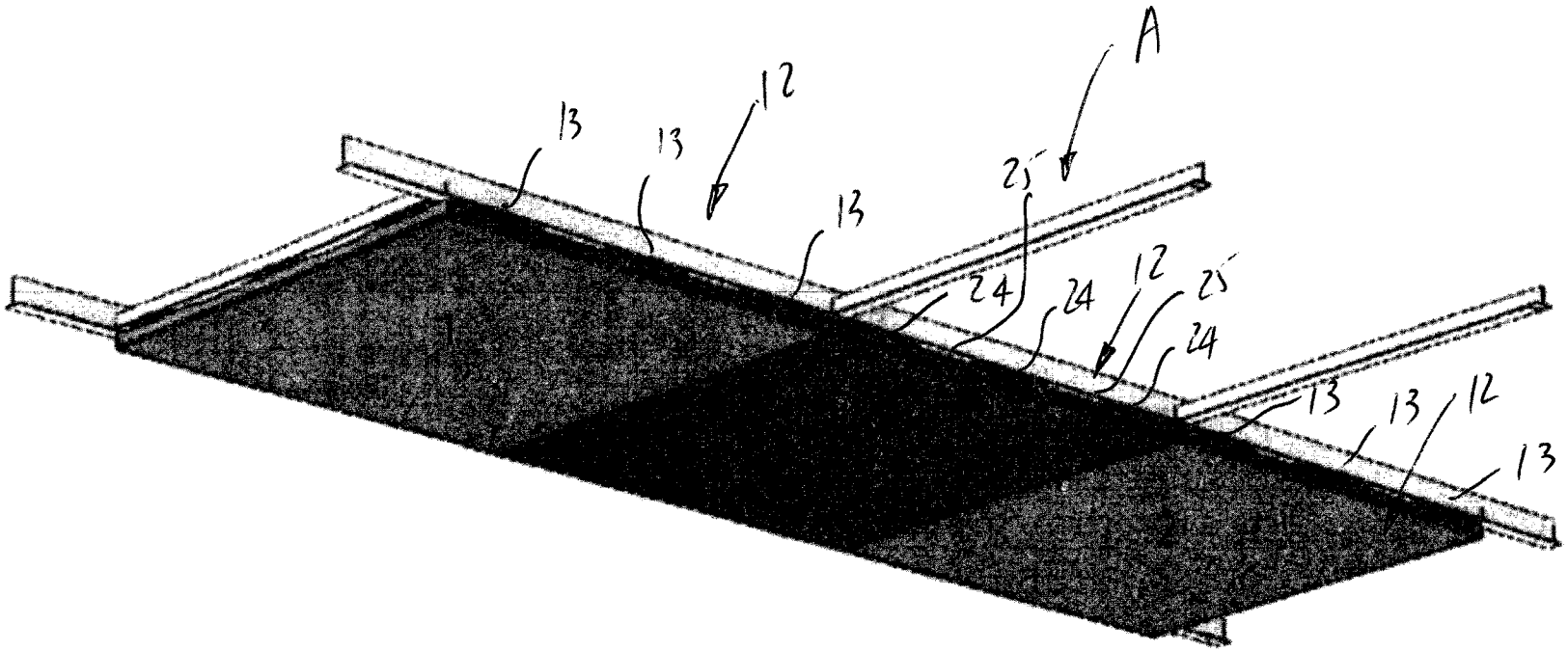

Therefore, as shown as FIG. 6, an assembly of three tiles 12 is suspended from the grid A. The sizing of the main body 12 is such that the spacing between the tiles 12 is relatively shut and the grid A is concealed and not visible from the floor. According to the arrangement of FIG. 6, the tiles 12 are arranged in a first set of tiles 12 and a second set of tiles 12. The tiles 12 of the first set of tiles have the tongues 24 of all four side surfaces 23 secured by fasteners (e.g., clips 13) to the grid A, while the tiles 12 of the second set have none of the tongues 24 of three of the four side surfaces 23, if not of all four of the side surfaces 23 secured by fasteners to the grid. The first set of tiles 12 and the second set of tiles 12 are in therefore in a checkered pattern.

Although a specific sequence has been described, other sequences may be used. For instance, the assembly of a first tile 12 as shown in FIG. 3 may be performed to then have a second tile 12 positioned directly next to the first tile 12 using the tongues 24 of the second tile 12 to be fitted into the grooves 25 of the first tile 12. The tongues 24 of the second tile 12 would then be clipped using the clips 13 on the side surface 23 that is away from the first tile 12. This is another way to proceed, but for which the second tile 12 has clips on only one of its side surfaces 23. Hence, the second tile 12 having clips on only one of its side surface 23 may be pivoted open about its connected side surface 23. In such a case, the second tile 12 may act as an access trap, with a flathead screwdriver (a.k.a., Robertson, flat screwdriver) being used to dislodge the unclipped tongues 24 from penetrating engagement in the grooves 25 of adjacent tiles 12.

The method for installing the tiles 12 to the grid A of a suspended ceiling may be described as first positioning the first tile 12 against the grid such that the tile is aligned with a cell of the grid and a rear plane of the first tile 12 is against a downwardly facing surface of the channels of the grid A. The tongues 24 of at least two side surfaces 23 of the first tile 12 are fastened to the channels of the grid A, for example with the clips 13. The tongues 24 of another tile 12 are inserted in the grooves 25 of the first tile 12, already attached to the grid A, such that the tongues 24 of the other tile 12 are sandwiched between the grooves 25 of the first tile 12 and the downwardly facing surface of the channels of the grid A.

The arrangement described using FIGS. 3 to 6 is convenient in that tiles 12 are either clipped or connected to the grid A, or supported by their tongues 24. In such a case, half of the tiles 12 are anchored to the grid A by the clips 13, while the other half of the tiles 12 is more easily removable as these tiles are simply top hung by their tongues 24 supported in the grooves 25 of the surrounding tiles 12. The removal of a tile 12 that is only supported by its tongues 24 is relative simple. For example, a flat screwdriver may be used for the removal.

End Moulding 14

Figure 7:
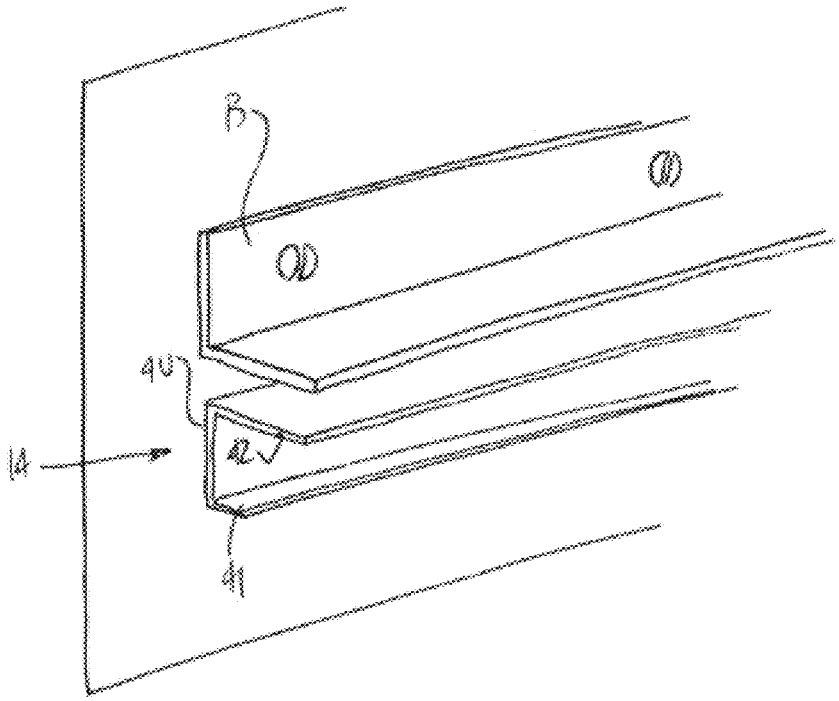
FIG. 7 is a perspective view of an end moulding of the tile system of the present disclosure relative to an L-shaped support.

Referring to FIGS. 7-9, at the junction between a vertical wall and the tile system 10, the end moulding 14 may be used. The end moulding 14 is a channel or strip that is secured to a conventional L-shaped peripheral channel of the grid A, as shown as B. The L-shaped channel B may, for instance, be bolted to the vertical wall, or attached in any other appropriate and conventional fashion. The end moulding 14 may be an extrusion, etc, and may consist of a plastic, metal or any other appropriate structural material.

The end moulding 14 has an L-shaped body 40 with an additional flange 41, forming a cavity for receiving an edge of the tiles 12. As shown in FIG. 8, the end moulding 14 may simply be secured to the L-shaped channel B by way of clips 13, in the same manner as are the tongues 24. This operation may be done before the installation of the tiles 12 in the sequence of FIGS. 3-6. As shown in FIGS. 7, 8 and 9, a channel 42 may be formed in an inner surface of the L-shaped body 40. The channel 42 is provided as purchase for the clips 13, to assist the clip 13 in remaining fixed to the end moulding 14.

In order to fit the tiles 12 with the cell of reduced size between the end moulding 14 and a T channel of the grid A, the tile 12 is cut to the appropriate width, if necessary, and is simply deposited in the cavity of the end moulding 14. The other uncut end of the tile 12 is connected to the T channel of the grid A in the manner described for FIGS. 3-6.

Although the method has been described for the installation of the tiles 12 to a suspended ceiling structure, the tiles 12 may be mounted directly to a wall, such as a vertical wall. In such a case, the clips 13 may not be useful, whereby other fasteners are used to fix the tongues 24 to the wall, such as staples or screws. If the wall is drywall, staples may provide sufficient anchoring.

Figure 12:
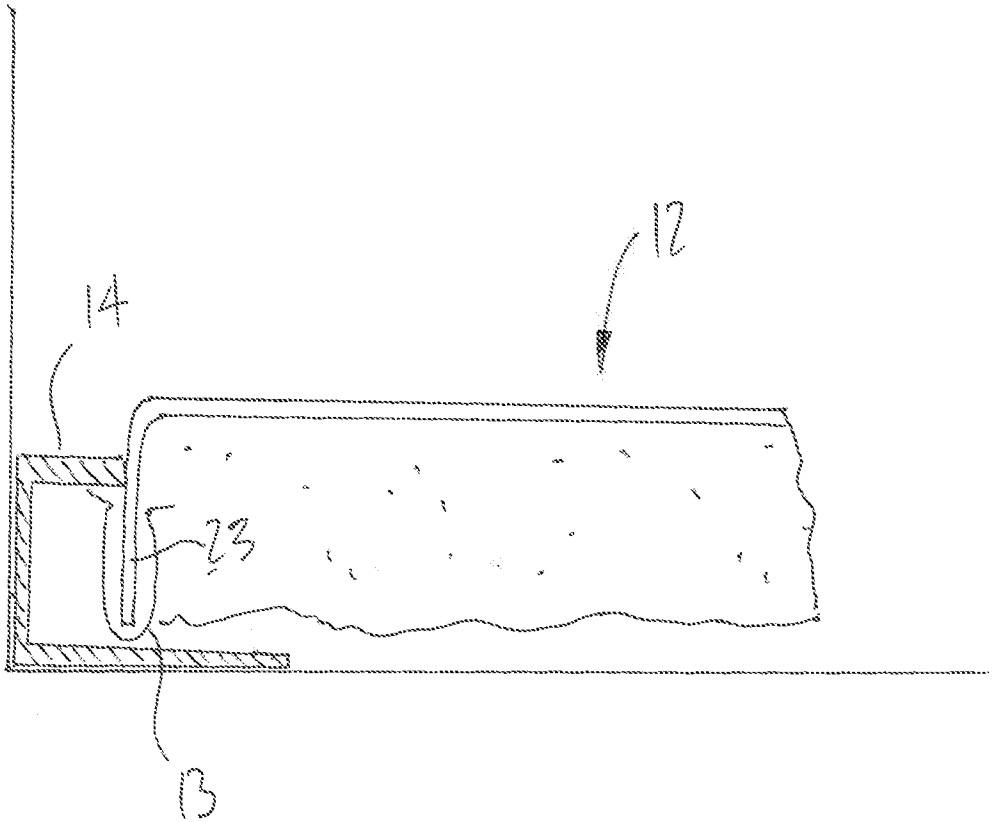
FIG. 12 is a top view of a tile of the tile system in the end moulding of FIG. 7, in a wall mount.

As shown in FIG. 12, an end moulding 14 may be used at the junction between two vertical walls, to support an edge of the tiles 12. The side surface 23 at the edge of the tile 12 may have its tongues 24 removed to be accommodated in the end moulding 14. Clips 13 may be used to ensure that the tile 12 is prevented from accidentally dislodging from the end moulding 14.

The invention claimed is:

1. A tile system for use on a grid of a suspended ceiling, comprising:

a plurality of tiles, each said tile having a main body having an exposed side and a concealed side, the exposed side defining a main surface, the concealed side defining a rear plane, and four side surfaces between the exposed side and the concealed side of the main body, wherein two of the four side surfaces have at least one tongue in the rear plane, and two other of the four side surfaces have at least one groove open to the rear plane; and clips biasingly sandwiching therebetween the tongues of one of the tiles and a horizontal strip portion of upside-down T channels of the grid, such that the rear plane of the tile is against a downwardly facing surface of the T channels of the grid;

wherein the tiles are arranged such that, for a pair of the tiles side by side and sharing a same channel, one of the tiles has the at least one tongue coplanar with a downwardly facing surface of the upside-down T channel, the at least one tongue being connected to the channel by at least one said clip, and the other of the tiles has its at least one groove receiving the at least one tongue of the adjacent tile.

2. The tile system according to claim 1, wherein the two of the four side surfaces with the at least one tongue have a first tongue-and-groove arrangement, wherein the two other of the four side surfaces with the at least one groove having a second tongue-and-groove arrangement, the first tongue-and-groove arrangement being complementary to the second tongue-and-groove arrangement, for complementary engagement of two of the tile side by side.

3. The tile system according to claim 2, wherein the main body and the tongue-and-groove arrangements are defined by a single piece shell.

4. The tile system according to claim 3, wherein the single piece shell has a hollow cavity opposite the main surface, a non-structural filler material being received in the hollow cavity.

5. The tile system according to claim 3, wherein a peripheral edge of the single piece shell, excluding grooves of the tongue-and-groove arrangements, lies in the rear plane.

6. The tile system according to claim 2, wherein opposite side surfaces of each said tile respectively have the first tongue-and-groove arrangement and the second tongue-and-groove arrangement.

7. The tile system according to claim 2, wherein the first tongue-and-groove arrangement has an alternating sequence of three tongues separated by two grooves, and wherein the second tongue-and-groove arrangement has an alternating sequence of three grooves separated by two tongues.

8. The tile system according to claim 1, wherein the main body has a size substantially equal to a cell defined by a central vertical strip portion of four of the upside-down T channels.

9. The tile system according to claim 1, wherein the tongues extend beyond a central vertical strip portion of the upside-down T channels of a cell supporting the tile.

10. The tile system according to claim 1, wherein at least one of the ends of the clips is a raised end.

11. The tile system according to claim 1, wherein the tiles are arranged in a first set of tiles and a second set of tiles, with all of the tiles having the tongues on all four side surfaces, the first set of tiles and the second set of tiles being in a checkered pattern, wherein the tiles of the first set of tiles have the tongues of all four side surfaces secured by the clips to the grid, and further wherein the tiles of the second set of tiles have none of the tongues of at least three of the four side surfaces secured by the cups to the grid.

12. A method for installing the tile system of claim 1 to a grid of a suspended ceiling, comprising:

positioning a first tile of the tiles against the grid such that the first tile is aligned with a four-sided cell of the grid and a rear plane of the first tile has the at least one tongue against a downwardly facing surface of four channels of the grid;

clipping the tongues of at least two side surfaces of the first tile to a horizontal strip of the channels by inserting the tongues of the at least two side surfaces of the first tile and the horizontal strip in the clips; and inserting at least one tongue of a second tile of the tiles in at least one groove of the first tile such that the at least one tongue of the second tile is sandwiched between the at least one groove of the first tile and the downwardly facing surface of the channels of the grid.

* * * * *